US005280802A

United States Patent [19]

Comuzie, Jr.

[11] Patent Number: 5,280,802

[45] Date of Patent: Jan. 25, 1994

[54] GAS APPLIANCE DETECTION APPARATUS

[76] Inventor: Franklin J. Comuzie, Jr., 230-03 Grand Central Pkwy., Bayside, N.Y. 11364

[21] Appl. No.: 976,540

[22] Filed: Nov. 16, 1992

[51] Int. Cl.[5] ..... F16K 17/36; F23N 5/24

[52] U.S. Cl. ..... 137/65; 122/504; 122/504.2; 122/507; 137/66; 340/632; 431/16; 431/22

[58] Field of Search ..... 137/65, 66, 78.5, 78.4; 122/504, 507, 504.2; 340/561, 577, 632, 640; 431/16, 18, 22

[56] References Cited

U.S. PATENT DOCUMENTS

| | | | |
|---|---|---|---|
| 1,734,257 | 11/1929 | Kraft et al. | 137/65 |
| 2,054,481 | 9/1936 | MacLean | 137/65 |
| 2,130,175 | 9/1938 | Betz et al. | 431/22 |
| 2,137,199 | 11/1938 | Betz | 431/22 |
| 2,290,049 | 7/1942 | Hildebrecht | 122/504 |
| 2,807,013 | 9/1957 | Prough et al. | 122/504.2 |
| 2,913,044 | 11/1959 | Mobley | 431/16 |
| 3,348,561 | 10/1967 | MacLennan | 137/66 |
| 3,537,803 | 11/1970 | Ignazio | 431/22 |
| 3,682,188 | 8/1972 | Randolph et al. | 137/66 |
| 4,171,944 | 10/1979 | Hirschmann | 431/22 |
| 4,401,425 | 8/1983 | Gable | 431/22 |
| 4,437,829 | 3/1984 | Baker | 431/22 |
| 4,751,912 | 6/1988 | Monette | 431/22 |
| 4,995,415 | 2/1991 | Weber | 137/66 |

*Primary Examiner*—George L. Walton
*Attorney, Agent, or Firm*—Leon Gilden

[57] ABSTRACT

A first and second sensor and alarm member is mounted relative to a gas appliance, and more particularly to the diverter housing and adjacent a lower portion of the gas appliance for detection of spillage in the form of flue restriction relative to the first sensor or roll-out sensing relative to gas fumes backed up relative to the flame portion of the gas appliance.

1 Claim, 4 Drawing Sheets

GAS APPLIANCE DETECTION APPARATUS

BACKGROUND OF THE INVENTION

1. Field of the Invention

The field of invention relates to detection apparatus, and more particularly pertains to a new and improved gas appliance detection apparatus wherein the same is arranged to detect gas fumes relative to spillage or roll-out relative to the appliance.

2. Description of the Prior Art

Gas spillage or spill is related relative to gas fumes that are directed relative to an environment of a gas appliance due to a flue having restriction therewithin. Roll-out is directed to fumes that are backed up at the flame portion of the appliance such as in a gas water heater in such conditions as a baffle portion of the appliance leading to the flue or chimney is subject to restriction. Such detection is mandatory at both positions of the appliance to insure detection of gas that may be directed into an environment of the gas appliance leading to physical injury relative to their inhalation and the like.

The prior art switch structure for effecting discontinuance of operation is noted in U.S. Pat. No. 3,710,294 to Dries wherein the thermal safety cut-out switch is provided permitting for its manual reset.

U.S. Pat. No. 4,995,415 to Weber sets forth a gas appliance shut-off method using switch structure incorporated herein by reference.

Accordingly, it may be appreciated there continues to be a need for a new and improved gas appliance detection apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of gas appliance apparatus now present in the prior art, the present invention provides a gas appliance detection apparatus wherein the same is arranged to detect fumes at a plurality of orientations relative to a gas appliance. As such, the general purpose of the present invention, which will be described subsequently in greater detail, is to provide a new and improved gas appliance detection apparatus which has all the advantages of the prior art detection apparatus and none of the disadvantages.

To attain this, the present invention provides a first and second sensor and alarm member mounted relative to a gas appliance, and more particularly to the diverter housing and adjacent a lower portion of the gas appliance for detection of spillage in the form of flue restriction relative to the first sensor or roll-out sensing relative to gas fumes backed up relative to the flame portion of the gas appliance.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, not is it intended to be limiting as to the scope of the invention in any way.

It is therefore an object of the present invention to provide a new and improved gas appliance detection apparatus which has all the advantages of the prior art gas appliance apparatus and none of the disadvantages.

It is another object of the present invention to provide a new and improved gas appliance detection apparatus which may be easily and efficiently manufactured and marketed.

It is a further object of the present invention to provide a new and improved gas appliance detection apparatus which is of a durable and reliable construction.

An even further object of the present invention is to provide a new and improved gas appliance detection apparatus which is susceptible of a low cost of manufacture with regard to both materials and labor, and which accordingly is then susceptible of low prices of sale to the consuming public, thereby making such gas appliance detection apparatus economically available to the buying public.

Still yet another object of the present invention is to provide a new and improved gas appliance detection apparatus which provides in the apparatuses and methods of the prior art some of the advantages thereof, while stimultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
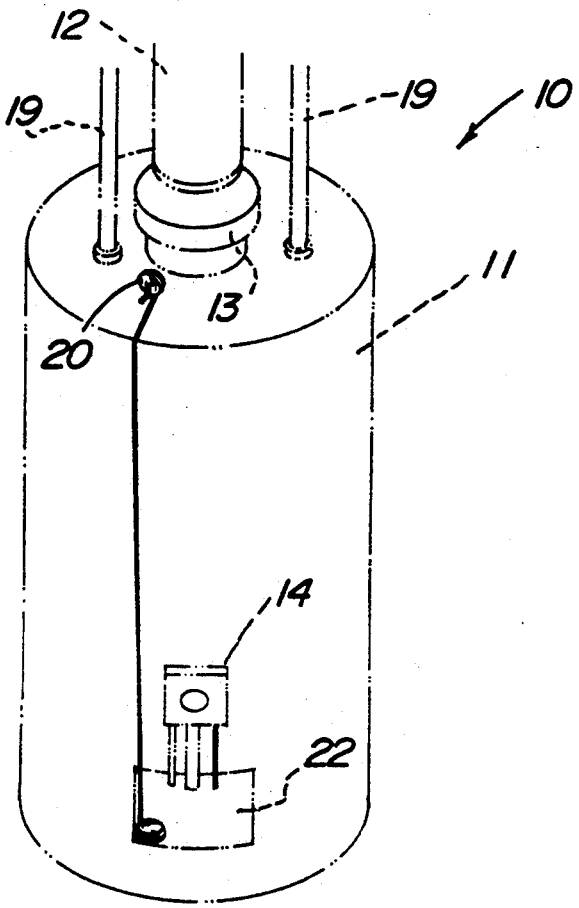
FIG. 1 is an isometric illustration of the instant invention.
Figure 2:
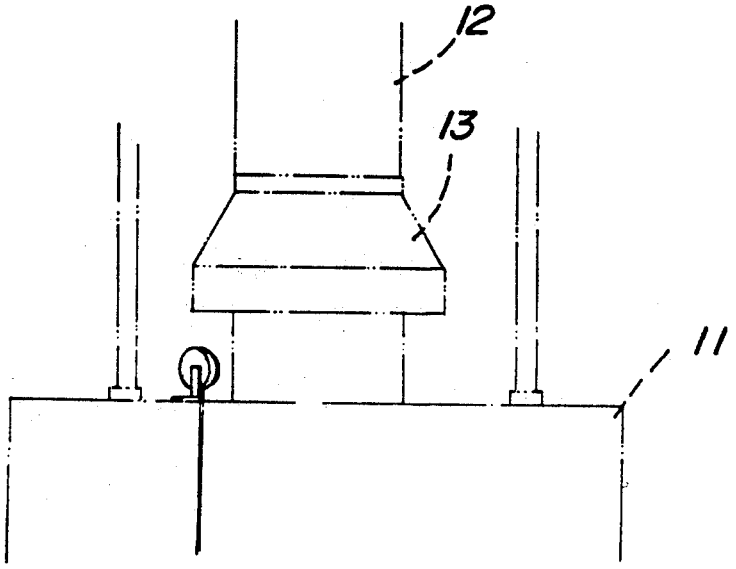
FIG. 2 is an orthographic view of the first gas insert switch member of the invention.
Figure 3:
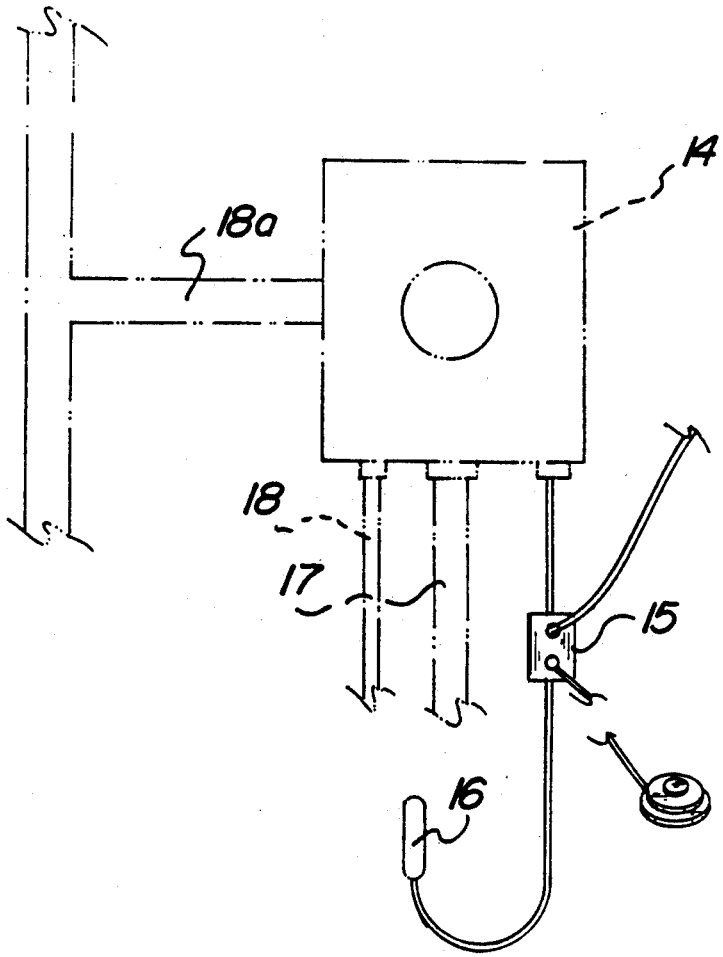
FIG. 3 is an isometric illustration of orientation of the second gas sensor and switch member of the invention.
Figure 4:
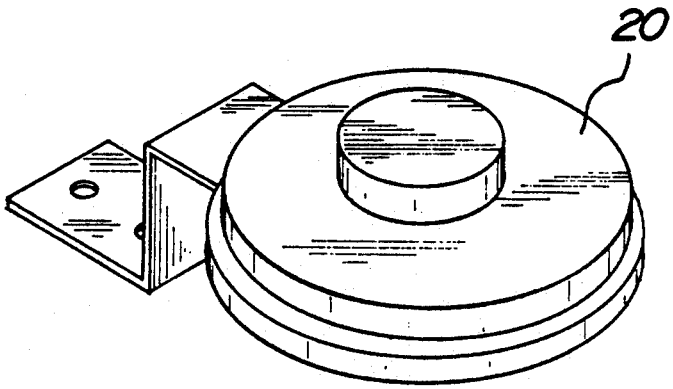
FIG. 4 is an isometric enlarged illustration of the first switch member.
Figure 5:
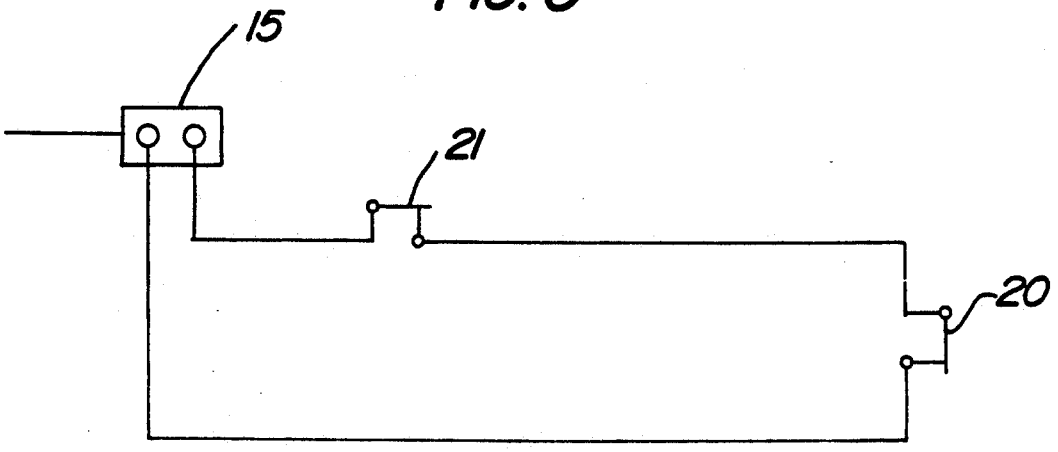
FIG. 5 is a diagrammatic illustration of the first and second switch members mounted in series relative to the terminal block assembly.
Figure 6:
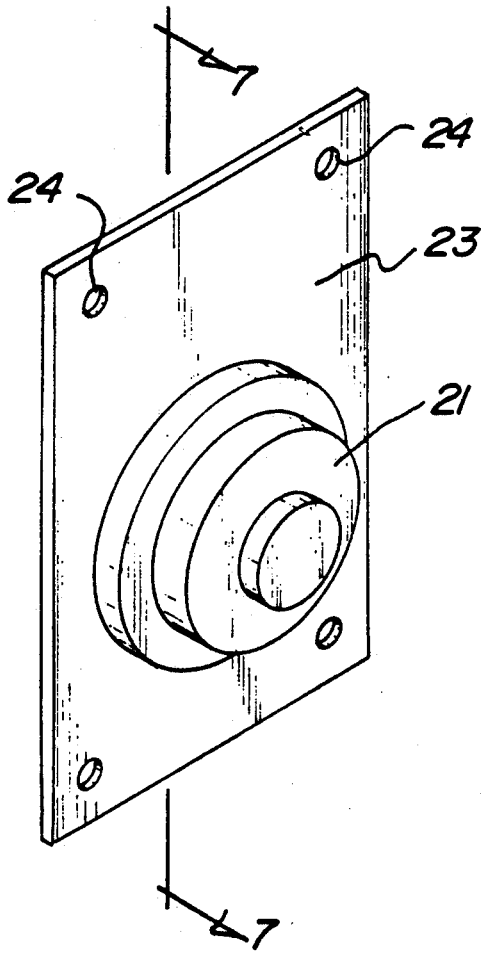
FIG. 6 is an isometric illustration of the second switch member and gas sensor structure.
Figure 7:
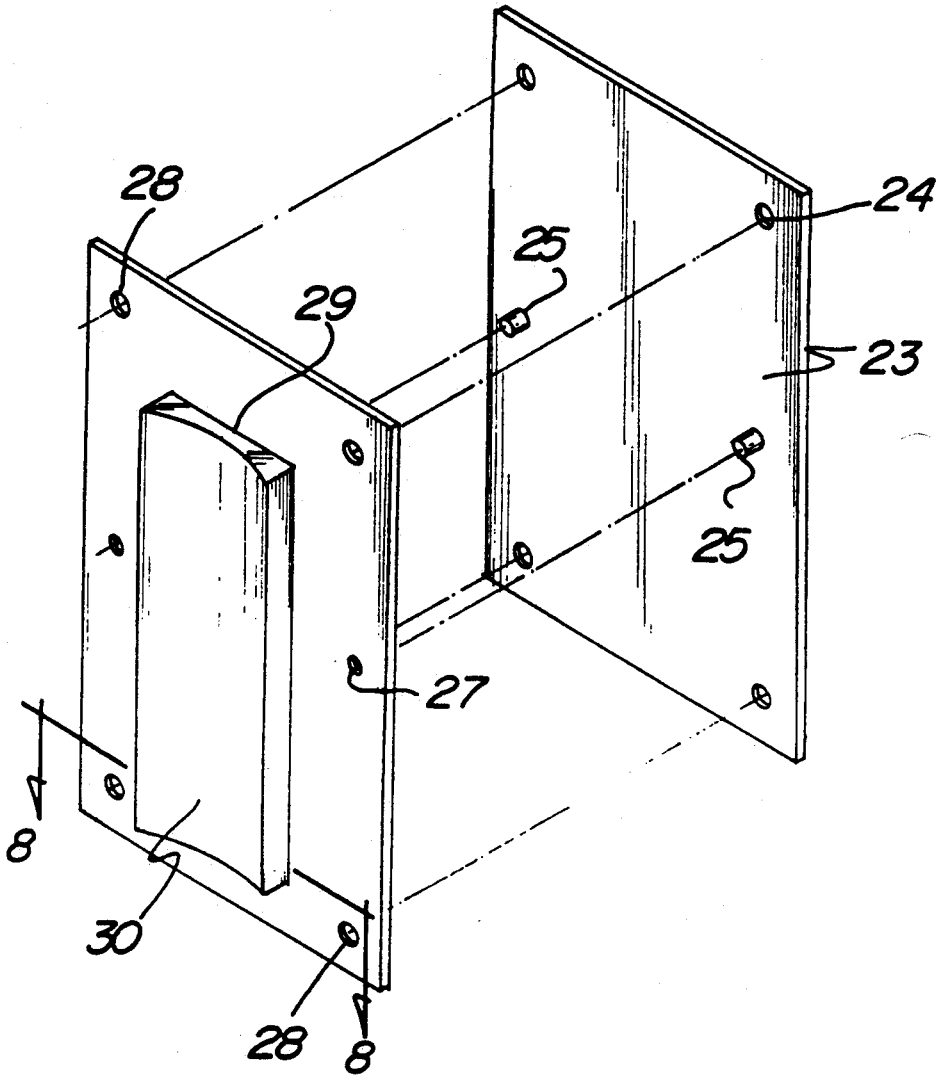
FIG. 7 is an isometric illustration, taken along the lines 7—7 of FIG. 6 in the direction indicated by the arrows.
Figure 8:
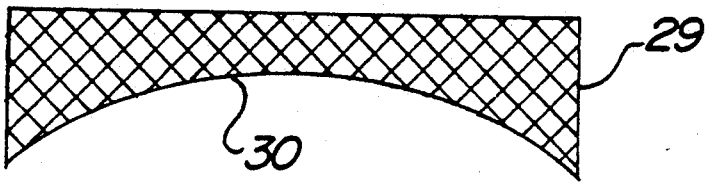
FIG. 8 is an orthographic view, taken along the lines 8—8 of FIG. 7 in the direction indicated by the arrows.

With reference now to the drawings, and in particular to FIGS. 1 to 8 thereof, a new and improved gas appliance detection apparatus embodying the principles and concepts of the present invention and generally designated by the reference numeral 10 will be described.

The U.S. Pat. No. 4,995,415 to Weber incorporated herein by reference indicates the use of shut-off switch structure relative to gas fired heating systems subject to flooding.

The instant invention attempts to address an organization wherein the gas appliance detection apparatus 10 of the invention essentially comprises the use of a gas appliance such as a water heater 11, having a flue pipe 12, and a diverter housing 13 mounted to the flue 12 in adjacency to an upper distal end portion of the hot water heater 11. A gas control valve 14 is provided mounted to the gas water heater positioned in adjacency relative to a gas appliance control cavity 22 having conventional gas burners and the like positioned therewithin. Reference to the FIG. 3 indicates the gas control valve 14 is cooperative with a terminal block assembly 15 operative through a thermocouple 16 to effect selective opening and closure of the gas control valve 14 directing gas from the gas supply line 17 to the pilot conduit 18, as well as the gas main supply conduit 18*a* from the gas supply line 17. It should be noted that fluid conduits 19 to include inlet and outlet conduits (see FIG. 1) are provided of conventional construction relative to the hot water heater, wherein their cooperation relative to the hot water reservoir tank is not believed to be necessary to one of ordinary skill in the art.

A first gas sensor 20 is mounted to the upper distal end of the hot water heater in adjacency relative to the flue and in adjacency to and preferably below the diverter housing 13 for detection of spillage which is known in the art to be resultant from fumes that are detected in adjacency to the diverter housing 13 relative to obstruction within the flue 12. A second gas sensor 21 is mounted in adjacency to the lower end portion of the hot water heater 11 relative to the gas appliance control cavity 22 for detection of roll-out effected by fumes that backup at the flame portion within the hot water heater due to baffling within the hot water heater being obstructed or collapsed. Upon such detection by either the first or second gas sensor 20 or 21, and as the first and second gas sensors 20 and 21 are in electrical series communication with the terminal block assembly 15, the terminal block assembly 15 is opened effecting closure of the gas control valve 14 eliminating further gas supply from the gas supply line 17 to the pilot conduit 18 and the gas main supply conduit 18*a* for the burner assembly of the gas appliance 11.

The second sensor 23 is subject to various orientations within and relative to the gas appliance and accordingly is mounted upon a second sensor metallic mounting plate 23 having mounting plate apertures 24 directed therethrough relative to the periphery of the plate 20 for ease of mounting of the metallic plate 23. To ease such mounting, and of optional construction, a plurality of projecting magnetic cylindrical members 25 are orthogonally mounted to the mounting plate projecting exteriorly thereof rearwardly of the second gas sensor 21. A further mounting plate 26 is provided having first apertures 27, wherein each of the first apertures are aligned with one of the mounting plate apertures 24. The further mounting plate includes second apertures 28, wherein one of the second apertures 28 is aligned with one of the magnetic cylinders 25 for mounting of the mounting plate 23 to the further mounting plate 26. The further mounting plate 26 further includes a ferromagnetic strip 29 having a concave face 30 to permit ease of magnetically adhering the further mounting plate relative to an interior surface within the cavity 22 or relative to an exterior surface of the gas appliance 11 for ease of such positioning.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gas appliance detection apparatus in combination with a gas appliance, wherein the gas appliance includes an appliance top wall spaced from an appliance bottom wall, with a gas appliance control cavity directed into the gas appliance in adjacency to the bottom wall, and a flue mounted through the top wall, and a diverter housing mounted about the flue in adjacency to the top wall, and a gas supply line, and a gas control valve receiving the gas supply line, and the gas control valve having a first gas outlet conduit and a second gas outlet conduit, with the gas control valve arranged to effect selective gas flow from the gas supply line to the first gas outlet conduit and the second gas outlet conduit, and a terminal block assembly in electrical communication with the gas control valve to effect selective opening and closure of the gas control valve, and a first gas sensor in electrical series communication with the terminal block assembly, with the first gas sensor mounted to the top wall in adjacency to the flue, and a second gas sensor mounted adjacent the bottom wall in adjacency relative to the gas appliance control cavity, and the second gas sensor and the first gas sensor are in series electrical communication with the terminal block assembly, whereupon sensing of gas fumes by the first gas sensor and the second gas sensor effects electrical opening of the terminal block assembly and closure of the gas control valve to prevent gas flow from the gas supply line through the gas control valve, and the second gas sensor includes a mounting plate, the mounting plate having mounting plate apertures directed through the mounting plate, and the mounting plate having a plurality of ferromagnetic cylinders mounted to the mounting plate, and a further mounting plate, the further mounting plate having first apertures, wherein each of the first apertures are aligned with one of the mounting plate apertures, and the mounting plate having second apertures, wherein each of the second apertures is arranged to receive one of the ferromagnetic cylinders therethrough to secure the mounting plate to the further mounting plate, and the further mounting plate having a ferromagnetic strip mounted medially of the mounting plate, and the magnetic strip including a concave face to permit ease of mounting of the ferromagnetic strip to an exterior surface of the gas appliance.

* * * * *